United States Patent [19]

Ingles

[11] 4,231,045

[45] Oct. 28, 1980

[54] WEATHER PROOF RADIO TOWER BEARING ASSEMBLY

[76] Inventor: Orrin E. Ingles, 5004 N. Graceland Dr., Peoria, Ill. 61614

[21] Appl. No.: 61,600

[22] Filed: Jul. 30, 1979

[51] Int. Cl.[3] ..... H01Q 3/04

[52] U.S. Cl. ..... 343/882

[58] Field of Search ..... 343/763, 765, 766, 880, 343/881, 882, 883

[56] References Cited

U.S. PATENT DOCUMENTS

| | | | |
|---|---|---|---|
| 2,583,210 | 1/1952 | Edwards | 343/760 |
| 2,642,754 | 6/1953 | DeConti | 343/763 |
| 3,604,009 | 9/1971 | Behnke | 343/757 |

*Primary Examiner*—Eli Lieberman

*Attorney, Agent, or Firm*—Richard L. Miller

[57] ABSTRACT

A bearing assembly for a radio tower, including a tubular bearing housing welded at its upper end to a triangular spreader plate supported on top of three legs of the tower; a lower end of the tubular bearing housing being welded to sidewardly extending arms that bear against a side of the tower legs, and the tubular bearing housing containing bearings that support rotatably free a vertical shaft of an antenna on its upper end.

2 Claims, 3 Drawing Figures

13
10
18
28
27
29
11
12
14
30
31
32
33
34
15
16
17
19
20
21
22
23
24
25
26

WEATHER PROOF RADIO TOWER BEARING ASSEMBLY

BACKGROUND OF THE INVENTION

This invention relates generally to radio towers. More specifically, it relates to a bearing housing of an antenna supported upon the tower.

It is well known to those skilled in the particular field that a radio antenna mounted on top of a shaft extending downward in a center of a radio tower is required to be free for directional rotation. Present constructions of these are subject to adverse weather such as rain, snow and ice that impare such free directional rotation of the shaft. This situation is accordingly in need of an improvement.

SUMMARY OF THE INVENTION

Therefore a principal object of the present invention is to provide a radio tower that has a bearing assembly for a freely rotatable shaft of a radio antenna, and the bearing assembly being made fully weather proof so that its friction-free movement does not become impared by inclement weather of rain, snow or ice as well as excessive heat from a sun that would dry out lubricants.

Another object is to provide a weather proof radio tower bearing assembly that can be easily installed on top of a radio tower, and which is designed for long use without need of frequent maintenance attention.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

The Figures on the drawings are briefly described as follows.

DETAILED DESCRIPTION OF PREFERRED EMBODIMENT

Figures 1, 2, 3:
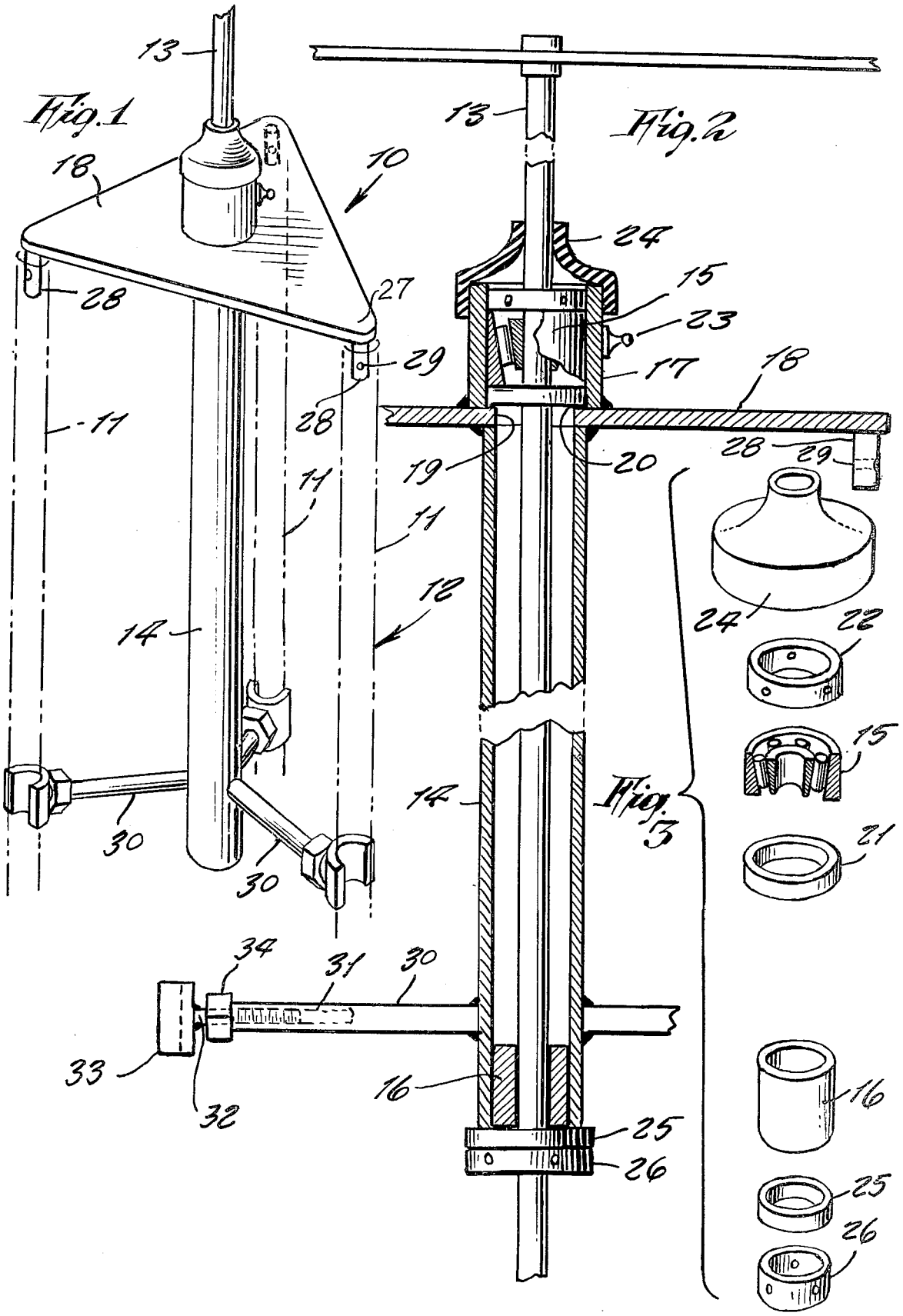
FIG. 1 is a perspective view of the tower bearing assembly.
FIG. 2 is a cross sectional view thereof.
FIG. 3 is an exploded perspective view of the bearing assembly components.

Referring now to the drawing in greater detail, the reference numeral 10 represents a weather proof radio tower bearing assembly which is installed on top of the vertical legs 11 of a tower 12 that supports rotatably free a vertical shaft 13 which at its upper end hold a radio antenna high in the air. In normal use of the antenna, the shaft is rotatable at its lower end so that the antenna can be directionally changed for receiving improved radio signals.

In the present invention, the bearing assembly includes a long, vertical, tubular housing 14 through which the shaft 13 extends, the shaft being supported rotatably free in a tapered bearing 15 (located above an upper end of the housing), and a bronze bearing 16 (mounted within a lower end of the housing). The bearing 15 is contained within a cylindrical case 17 welded on top of a spreader plate 18 which in turn is welded upon a top of the tubular housing 14. A hole 19 is provided through the spreader plater for the shaft to extend therethrough. The interior of the case is larger than the hole 19, so that a shoulder 20 is thus formed and upon which a grease retainer 21 is rested, the retainer supporting the tapered bearing thereupon. A shaft collar 22 is located above the tapered bearing. A grease fitting 23 located outside of the case, so that lubricant is provided to the tapered bearing. A rubber boot 24 fitted snug around the shaft and the case seals the bearing from weather above.

At a lower end of the shaft a bronze bearing rests upon a grease retainer 25 resting upon a collar 26 affixed to the shaft. The retainer and collar are larger than the housing diameter so that the shaft is locked from sliding vertically with respect to the housing.

The spreader plate 18 is triangular in shape, and a stub shaft 28 is affixed under each corner 27 of the plate; the stub shafts being receivable within openings at the upper ends of the tower legs; the legs thus supporting the plate. A transverse hole 29 in each stub shaft is provided for securement means such as a bolt for rigidly holding the leg.

Near a lower end of the housing, three equally spaced apart, centering arms 30 extend radially sidewardly from the housing and are welded thereto. An outward end of each arm has a clearance hole 31 slidably receiving a rod 32 having a semi-cylindrical pad 33 on its end for bearing against a leg of the tower.

Each rod is threaded so to engage a nut 34 which bears against the end of the arm 30, thus keeping the arm and rod under compression force. Thus the arms are centered in the housing.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

I claim:

1. A weather proof, radio tower, bearing assembly, comprising in combination a tubular housing through which a shaft extends having an antenna on its upper end, a tapered upper bearing supporting an upper end of said shaft, and a bronze lower bearing in a lower end of said housing supporting a lower end of said shaft rotatably free, and means for support of said housing on the legs of said radio tower, wherein said means comprises a triangular plate affixed to an upper end of said housing, and stub shafts at corners of said plate engaging said posts, wherein said means further comprises sideward arms from a lower portion of said housing for bearing against sides of said legs, and wherein a boot and case enclose said tapered bearing.

2. The combination as set forth in claim 1 wherein said upper bearing and said lower bearing are separated by a distance which is several times the diameter of said shaft.

* * * * *